US007114720B1

(12) United States Patent
Whitehurst

(10) Patent No.: US 7,114,720 B1
(45) Date of Patent: Oct. 3, 2006

(54) GAME DEVICE AND METHOD FOR PLAYING

(76) Inventor: J. Paul Whitehurst, 1955 22nd St., Northport, AL (US) 35476

( * ) Notice: Subject to any disclaimer, the term of this patent is extended or adjusted under 35 U.S.C. 154(b) by 0 days.

(21) Appl. No.: 10/631,608

(22) Filed: Jul. 31, 2003

(51) Int. Cl.
*A63F 3/00* (2006.01)

(52) U.S. Cl. ..... 273/241; 273/271

(58) Field of Classification Search ..... 273/241, 273/272; D21/351, 352
See application file for complete search history.

(56) References Cited

U.S. PATENT DOCUMENTS 3,046,016 A * 7/1962 Laws ..... 273/241
4,456,258 A * 6/1984 Lodrick ..... 273/241
4,625,967 A * 12/1986 Yu ..... 273/153 S
6,120,027 A * 9/2000 Frankel et al. ..... 273/236
6,398,221 B1 * 6/2002 Graham ..... 273/157 R

* cited by examiner

*Primary Examiner*—Vishu Mendiratta
(74) *Attorney, Agent, or Firm*—Karen B. Tripp; Elizabeth Layman

(57) ABSTRACT

A game device having a three-dimensional playing surface with strategically positioned points and a method of playing a game on the game device which has a three-dimensional playing surface with strategically positioned points whereby the game is played by at least two players alternately claiming the points.

3 Claims, 2 Drawing Sheets

GAME DEVICE AND METHOD FOR PLAYING

FIELD OF THE INVENTION

This invention relates generally to amusement devices and board games and specifically to game devices and methods of playing games on game devices involving a strategic race to a finish, an alignment of pieces, and the movement of pieces over a board having a pattern.

BACKGROUND OF THE INVENTION

The general trend in games today has gravitated toward computerized video games that are mainly single-player games where the player memorizes the steps of the game that are required to achieve the objective. The player then continuously repeats the steps to improve his/her time.

With the advent of video games came a decline in games between two or more players competing face-to-face against each other where the object is to defeat the opponent by outwitting him/her. Traditionally this was an important feature of games and such games between two people were a major means of entertainment and social interaction.

Many games today, however, are played by a single player with no other person participating or watching. At the end of the game the player receives a "score" for the points he/she has accumulated during the game. An opponent or the original player then tries to match or beat the original player's score. There is no player-to-player real-time opposition.

Some existing games such as the cubic game board (U.S. Pat. No. 4,129,303) have attempted to enhance the popularity of the game board concept by making the game three-dimensional. The playing surface, however, continues to be planar even though multiple planes are incorporated into the game device.

Another game apparatus (U.S. Pat. No. 3,046,016) transforms the traditional tic-tac-toe game into three-dimensions. The apparatus is designed strictly for this one game and requires points or "playing stations" at all intersections of the rings and additional intermittent "playing stations" between each adjacent pair of intersections. By including intermittent points which only have two adjacent points, the game complexity is diminished.

Another adaptation of the tic-tac-toe concept is a game apparatus (U.K. Patent No. 1,344,259) by Frank Fox. It is a three-dimensional representation of the British game of noughts and crosses which has at least two 3×3 arrays of contiguous areas with at least one area common to two such arrays. Each array has nine compartments (three different shapes: square, rectangular and triangular) formed by the 3×3 game board where two players alternately put crosses and circles in the compartments. The objective is to be the first player to get three crosses or three circles in contiguous compartments. The game is also called tic-tac-toe, tit-tat-toe, ticktacktoe and ticktacktoo. This game, as the others discussed above, does not have desired characteristics such as visualization of spatial relations, increased ability of players to visualize three-dimensional images and increased complexity. It also lacks a means of identifying the winning alignment on the sphere and is limited to playing patterns which are composed of 3×3 grids.

SUMMARY OF THE INVENTION

The invention is a game device and a method of playing a game on a game device having a three-dimensional playing surface with strategically positioned points. The objectives of the various games of the invention include a strategic race to a specified finish, the claiming of the most points, the first to claim a specific number of adjacent points and the movement of game pieces over a specified pattern on the game device.

Therefore, it is an object of this invention to increase the player's awareness of spatial relations, to increase the player's ability to visualize three-dimensional images and to add complexity to existing two-dimensional games.

It is a further object of this invention to provide a game device and games that refocus game-playing on social interaction and strategic and tactical moves to outwit the opponent by making the game device more challenging and attractive.

BRIEF DESCRIPTION OF THE DRAWINGS

The foregoing and other advantages of the invention will become apparent upon reading the following detailed description and upon reference to the drawings in which.

DESCRIPTION OF THE PREFERRED EMBODIMENT

Figure 1:
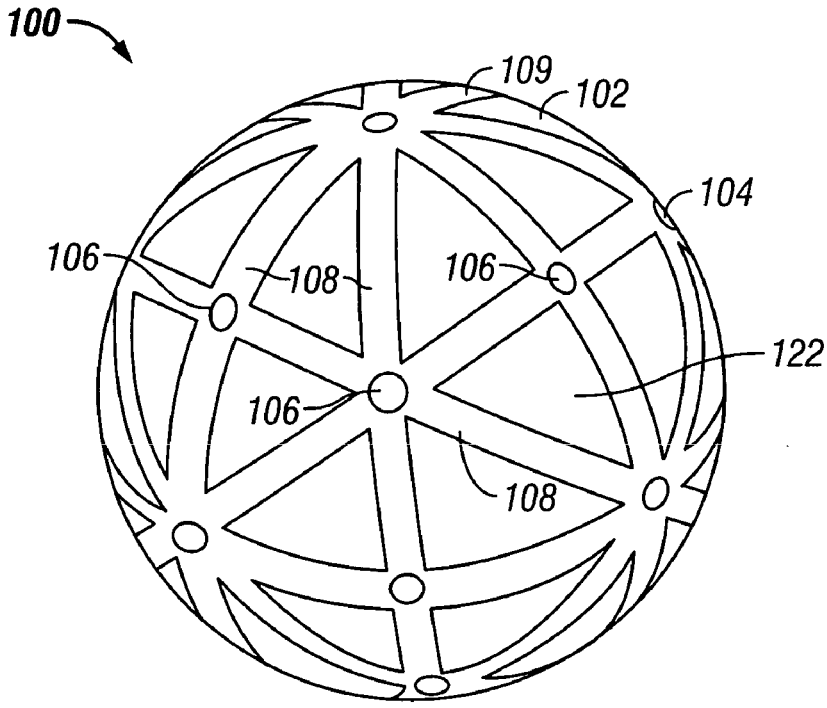
FIG. 1 is a perspective view of one embodiment of the present invention.

As shown in FIG. 1, the preferred embodiment is a wooden game device 100 constructed in the shape of a sphere of approximately four-inches in circumference. The material and size of the game device 100 are meant by way of example and are not meant to limit the scope of the invention. The attraction of the four-inch design is that it is portable and can easily be passed among the players. The weight and feel of the wood game device 100 also are appealing to the players. The wooden game device 100 feels substantial and is attractive.

The game is designed for play by two or more persons but can be played by a single person playing as two or more players.

The playing surface 102 contains a plurality of great circles 104 that intersect at points 106. The parts of the great circles 104 that lie between adjacent points are referred to as lines 108. An interesting aspect of the game device 100 is that only a part of the total playing surface 102 is visible to the player at any given time. Consequently the player must rotate the game device 100 to view the total playing surface 102. Even then, the lines 108 along the great circles 104 do not appear straight unless viewed at the correct angle. In a game where alignment is important, this creates the tendency for the players to overlook arrangements of points 106 and gives an advantage to those players who are skilled in spatial perception and visualizing three-dimensional images.

There are many patterns that can be formed on the game device 100. The preferred embodiments of the game device 100, as shown in FIGS. 1–4, contain patterns that are based on great circles 104. A great circle 104 being defined as a circular line on the surface of a sphere formed by the intersection of the sphere with a plane passing through the center of the sphere. The two patterns shown are based on geometric solids that are superimposed on a spherical surface such as the game device 100.

Figure 3:
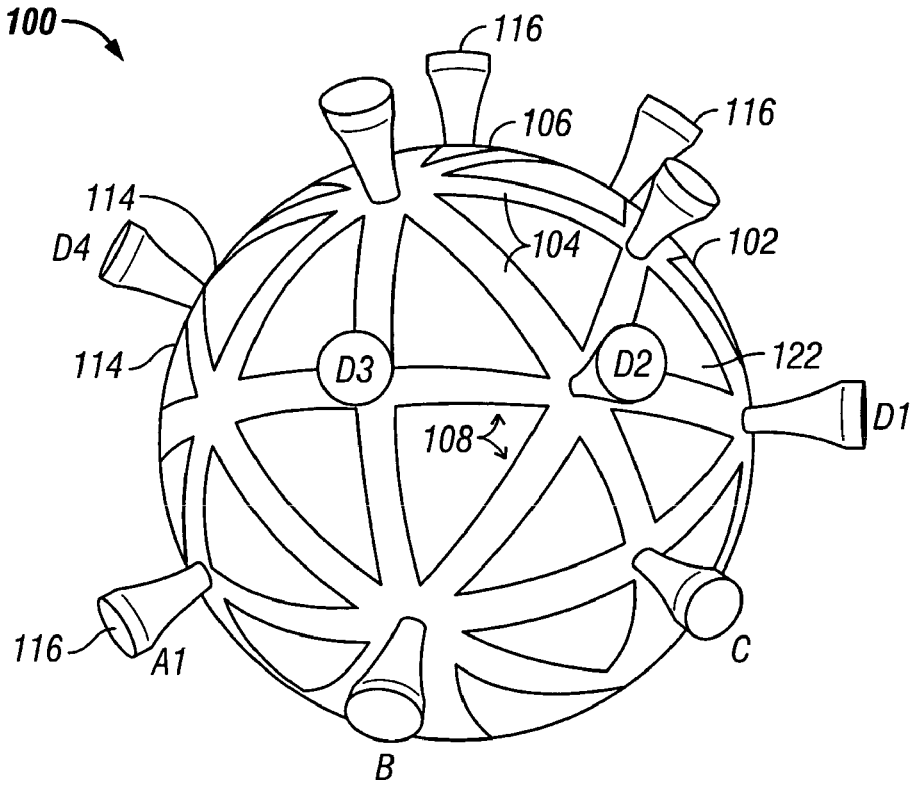
FIG. 3 illustrates the use of game pegs in the present invention.

The first pattern, as shown in FIGS. 1 and 3, is based on a geometric solid called a Disdyakis Dodecahedron. When this geometric solid is superimposed on the spherical game device 100, it creates a patterned game device 100 composed of nine great circles 104. These great circles 104 correspond to the edges of the Disdyakis Dodecahedron. The great circles 104 intersect at twenty-six distinct points. These points 106 correspond to the twenty-six vertices of the Disdyakis Dodecahedron.

Figure 2:
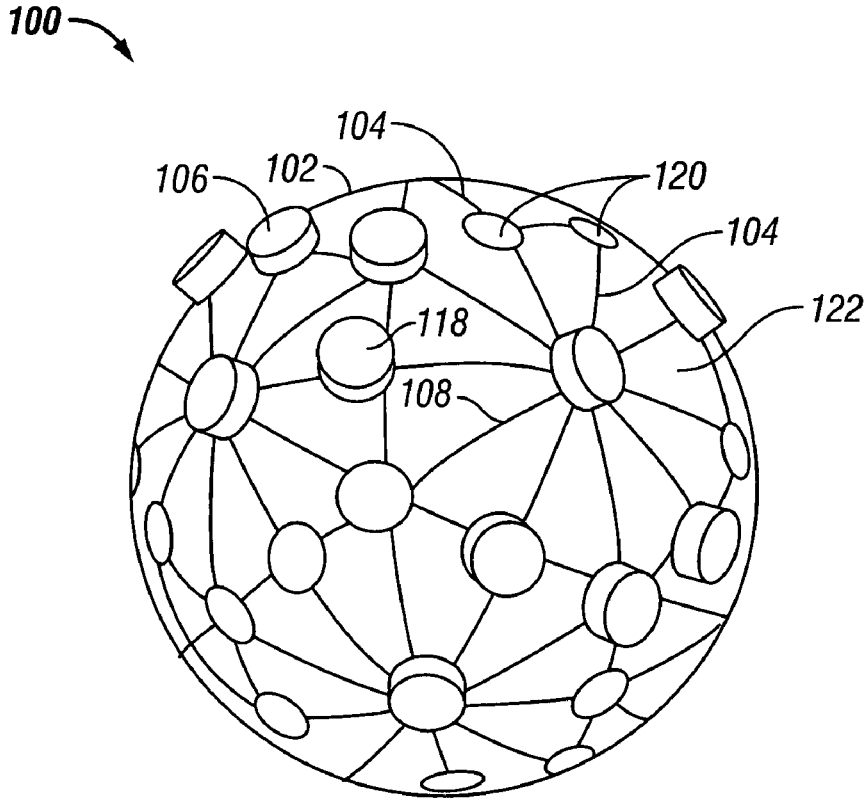
FIG. 2 is a perspective view of a second embodiment of the present invention.
Figure 4:
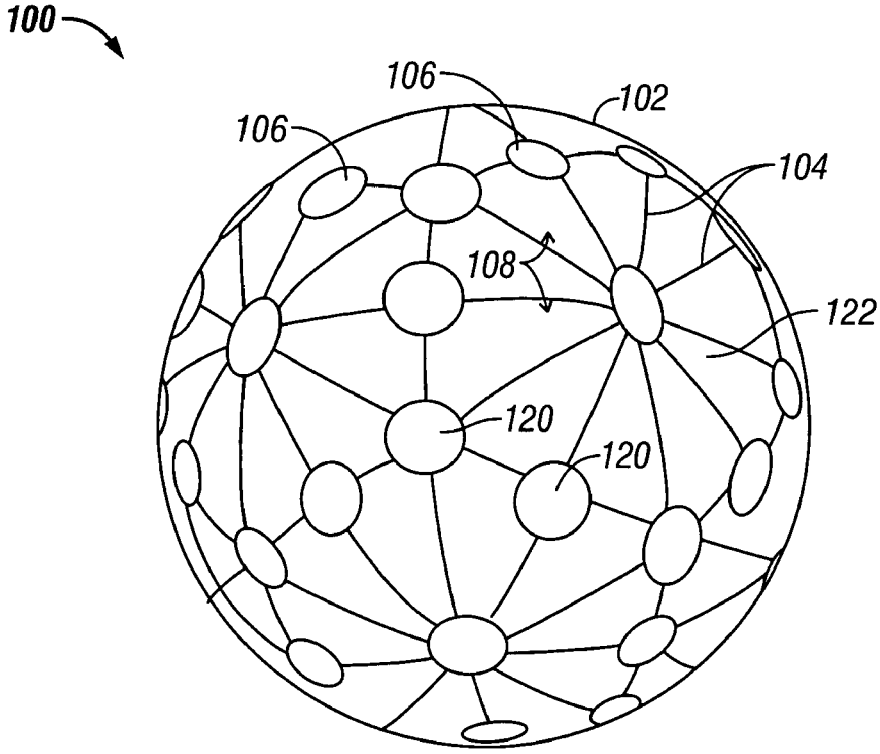
FIG. 4 illustrates the use of magnets in the present invention.

The second pattern, as shown in FIGS. 2 and 4, is based on a geometric solid called a Disdyakis Triacontahedron. This geometric solid is related to the Icosahedron which is familiar to most people as the geodesic dome of Buckminster Fuller. The superimposition of this geometric solid on the game device 100 creates a patterned game device 100 composed of fifteen great circles 104 that intersect at sixty-two distinct points 106.

All areas 122 formed by the intersecting great circles 104 in the two patterns described above are triangular in shape.

The twenty-six point game device 100 (FIGS. 1 and 3) has some advantages over the sixty-two point game device 100 (FIGS. 2 and 4). On the game device 100 shown in FIGS. 1 and 3 there are only three possible lengths of the lines 108 between any two adjoining points 106. From a visual standpoint there is not a great difference between the smallest and the largest of these lengths. This makes it easier for the players to perceive alignments of adjoining points 106 on the great circles 104.

The game device 100 as shown in FIGS. 2 and 4 has four possible lengths of the lines 108 between any two adjoining points 106. From a visual standpoint, there is a considerable difference between the length of the smallest line 108 and the largest line 108. This makes it more difficult for players to perceive alignments of adjoining points 106 along the great circles 104.

There are many different geometric solids that can be superimposed on a sphere to create game devices 100. The above two geometric solids are meant by way of example and are not meant to limit the scope of the invention.

The two patterns described in this preferred embodiment are constructed entirely of great circles 104. This gives them an advantage as a game device for alignment games. If the points 106 are connected by lines 108 that are not on great circles 104, it is extremely difficult to visualize which points 106 are in a straight line. Multiple lines 108 intersect at each point 106. When the lines are not on great circles it is not easy to visualize where a line 108 entering a point 106 goes after it crosses the point 106. With great circles 104 every line 108 appears to cross each point 106 in a straight line when viewed from directly above the great circle 104.

The object of the game can be for a player to get the most adjacent points 106 in a row or to be the first player to claim a specified number of adjacent points 106 in a row. These two objects are meant by way of example and are not meant to limit the scope of the invention.

With four points in-a-row, the player who goes first has a distinct advantage and can always win. Five points in-a-row is a much more challenging game and the player going first possibly has a slight advantage. The four-in-a-row game might be more desirable for younger players and those first learning the game.

With only twenty-six points on the game device 100 shown in FIGS. 1 and 3, a player might be concerned that there would be frequent draws (ties) while trying to get five-in-a-row. This does occur. In fact a player can almost always force a draw if he/she sets out to do so. Surprisingly however, if players do not intentionally play to draw, one player frequently will make five-in-a-row. An attractive feature of the game is that the winning player often does not make five-in-a-row until almost all the points on the game device 100 are claimed.

Typically, a five-in-a-row game on the 26-point game device 100 (FIGS. 1 and 3) takes about 10 to 20 minutes to complete. This seems to be an acceptable time for short attention span players. It also seems to be acceptable for multiple games with onlookers because there is not too much lag time for the onlookers who are waiting to play. If the players are engrossed in the game, they can play numerous successive games. The players can also quit in the middle of a game without having invested a large amount of time in a game.

The 62-point game device 100 (FIGS. 2 and 4) can be played the same way. It appears that the 62-point game device 100 lessens the likelihood of draws. It also appears that the length of time playing for five-in-a-row is about the same as on the 26-point game device 100. Players can also attempt six or seven-in-a-row and more.

The game can be made more complicated by allowing a first player to use his/her turn to move a second player's game peg 116 from a first point 106 to a different point 106 on the game device 100.

The 62-point game device 100 (FIGS. 2 and 4) has unique strategies when played with more than two players. Each player must make tactical decisions about whether to block another player or force a third player to accomplish the block.

There are many ways to visually show which points 106 a player claims. Erasable marker pens can be used to indicate the players' claimed points 106 but markings (not shown) tend to require touchups during the game when the game device 100 is handled a lot and the markings fade.

The game device 100 can be made with holes 114 drilled at the locations of the points 106, as shown in FIG. 3, so that the points 106 can be claimed with game pegs 116 such as golf tees which are beveled toward the top. When inserted in a hole 114 drilled slightly larger than the bottom of the beveled game peg 116, the game peg 116 becomes wedged in the hole 114. It only takes a small amount of force to insert the game peg 116 sufficiently such that the game peg 116 will stay in the hole 114 when the game device 100 is turned upside down while being rotated as the game is played. After several game pegs 116 are inserted during play, the game device 100 takes on an artistic, futuristic appearance which seems to enhance the attractiveness of the game for the players.

Another method of visually marking the claimed points 106 is with magnets 118 as shown in FIG. 4. Nails 120 can be inserted into the game device 100 at each of the points 106 (see FIGS. 2 and 4). A small magnet 118 with a distinguishing color or marking can then be placed on the appropriate nail 120 to indicate which point 106 the player is claiming. One disadvantage of the magnets 118 is that more care must be used in handling the game device 100 to prevent the magnets 118 from being dislodged.

One consideration in the use of the game pegs 116 or magnets 118 is their small size. This presents a potential swallowing hazard for small children and a suitable warning to adults about limiting or supervising the game-playing by small children should be made.

To solve the problem of small pieces, a preferred embodiment (not shown) of the game device 100 uses points 106 having a set of embedded features instead of magnets 118 and game pegs 116. In this embodiment, the set for each point 106 has at least a neutral feature, a first distinguishing feature and a second distinguishing feature. At the start of the game, the set of embedded features for each point 106 is positioned to the neutral feature. The first player claims a point 106 by changing the feature (not shown) of the claimed point 106 from the neutral feature to the first distinguishing feature. Similarly, the second player claims a point 106 by changing the feature (not shown) of the claimed point 106 from the neutral feature to the second distinguishing feature.

Although the preferred embodiment of the game is as an alignment game, this is not the exclusive means of playing games on this game device 100. There is a game called Slither that is played by connecting points on a grid (not shown). Each point can only connect to one other point. The last player who can connect a point to another point is the winner. A version of this game can be played on this game device 100. It is a simple matter to put pegs in all the holes and then connect them with rubber bands.

A myriad of other games can be played on the game device. For example, a game like Chinese checkers can be played as well as other games such as Go or Othello. These games are meant by way of example and are not meant to limit the scope of the invention.

The game device 100 can also be transformed for play on a computer or video screen by adapting software into a depiction of these three dimensional games.

Although the invention has been described in terms of certain preferred embodiments, it will be apparent to those of ordinary skill in the art that modifications and improvements can be made to the inventive concepts herein without departing from the scope of the invention. The embodiments shown herein are merely illustrative of the inventive concepts and should not be interpreted as limiting the scope of the invention.

ELEMENTS

100 game device
102 playing surface
104 great circles
106 points
108 lines
100 26-point game device
100 62-point game device
114 holes
116 game pegs
118 magnets
120 nails
122 triangular areas on the playing surface formed by the intersecting great circles

What is claimed is:

1. A method of playing a game on a game device, wherein said game device comprises a three-dimensional, spherical playing surface having strategically positioned points formed by intersecting great circles and wherein said game is played by at least two players comprising the steps of the players alternately claiming the points, and wherein each point further comprises a set of embedded electronic features, each said set having at least a neutral feature, a first distinguishing feature and a second distinguishing feature, wherein at the start of the game, the neutral feature of each point is displayed and wherein the first player claims a point by changing the feature of the claimed point from the neutral feature to the first distinguishing feature and the second player claims a point by changing the feature of the claimed point from the neutral feature to the second distinguishing feature.

2. The method of claim 1 further comprising a representation of the game on a video screen.

3. The method of claim 1 further comprising a representation of the game on a computer.

* * * * *